US008217578B2

(12) United States Patent
Takacs et al.

(10) Patent No.: US 8,217,578 B2
(45) Date of Patent: Jul. 10, 2012

(54) LED LIGHTING ARRANGEMENT

(75) Inventors: Laszlo A. Takacs, Lakewood, OH (US); Roger F. Buelow, Gates Mills, NY (US)

(73) Assignee: Energy Focus, Inc., Solon, OH (US)

( * ) Notice: Subject to any disclaimer, the term of this patent is extended or adjusted under 35 U.S.C. 154(b) by 447 days.

(21) Appl. No.: 12/490,161

(22) Filed: Jun. 23, 2009

(65) Prior Publication Data

US 2010/0156298 A1 Jun. 24, 2010

Related U.S. Application Data

(60) Provisional application No. 61/074,870, filed on Jun. 23, 2008, provisional application No. 61/074,874, filed on Jun. 23, 2008.

(51) Int. Cl.
*H05B 37/00* (2006.01)
*H05B 41/14* (2006.01)

(52) U.S. Cl. ..... 315/86; 315/87; 315/88; 315/160

(58) Field of Classification Search ..... None
See application file for complete search history.

(56) References Cited

U.S. PATENT DOCUMENTS

| | | | | |
|---|---|---|---|---|
| 6,137,816 | A * | 10/2000 | Kinbara | 372/29.012 |
| 7,265,952 | B2 * | 9/2007 | Chiang et al. | 361/8 |
| 7,800,316 | B2 * | 9/2010 | Haug | 315/299 |
| 2008/0310162 | A1 * | 12/2008 | Thomas et al. | 362/249 |

OTHER PUBLICATIONS

Diode, http://en.wikipedia.org/wiki/Diode (visited Jun. 22, 2009), 13 pages.

* cited by examiner

*Primary Examiner* — Anh Tran
(74) *Attorney, Agent, or Firm* — Bruzga & Associates; Charles E. Bruzga

(57) ABSTRACT

An LED lighting arrangement comprising at least one LED, for producing light is disclosed. A power supply provides power for the at least one LED. At least one control circuit is coupled to the at least one LED in a way that directly or indirectly uses, to power the at least one control circuit, one or more forward voltage drops across the at least one LED. Beneficially, one or more additional control circuits can be added without redesign of the power supply for the at least one LED.

9 Claims, 6 Drawing Sheets

LED LIGHTING ARRANGEMENT

FIELD OF THE INVENTION

The present invention relates to an LED lighting arrangement. More particularly, the present invention relates to an LED lighting arrangement in which control circuitry is powered directly or indirectly from the forward voltage drop across one or more LEDs.

BACKGROUND OF THE INVENTION

Most LED power supply (or driver) circuits are commonly sold in modules that also include various control circuits to provide such features as timing functions, dimming capabilities, motion sensors, demand response features, color changing, etc. Accordingly, there are many basic functions in addition to electrical current control for LEDs that are typically incorporated into a driver module to control the LEDs.

A drawback of the foregoing LED driver module is that all of the control circuits are typically included in the driver module. As a result, adding new control functionality to an LED lighting fixture can be expensive and time-consuming in that a new driver module design must be completed, built and tested if added control circuits are required. A need exists, therefore, for an LED lighting arrangement in which additional control circuits can be added without redesign of an LED driver module.

BRIEF SUMMARY OF THE INVENTION

In one form, the invention provides an LED lighting arrangement comprising at least one LED, for producing light. A power supply provides power for the at least one LED. At least one control circuit is coupled to the at least one LED in a way that directly or indirectly uses, to power the at least one control circuit, one or more forward voltage drops across the at least one LED.

The foregoing LED lighting arrangement beneficially allows one or more additional control circuits to be added without redesign of an LED driver module.

BRIEF DESCRIPTION OF THE DRAWING

In the drawings, in which like reference numerals refer to like parts.

DETAILED DESCRIPTION OF THE INVENTION

After describing the general concept of powering control circuits from one or more LEDs, the present description considers examples of control circuits and details of LED power supplies, which are typically called driver modules.

Powering Control Circuits from LED(s)

Figure 1:
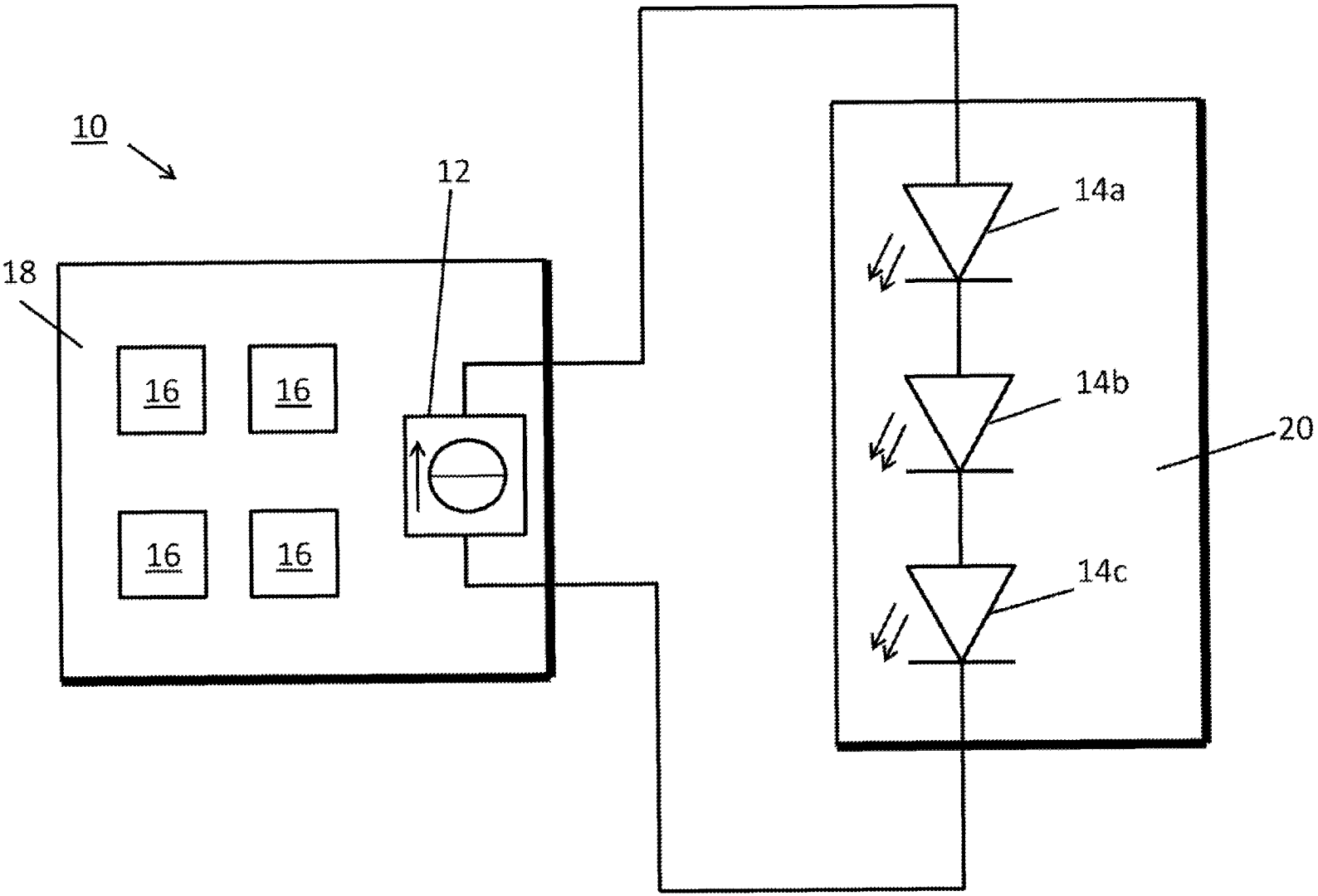
FIG. 1 (Prior Art)
FIG. 1 shows a simplified top plan view, including an electrical schematic, of printed-circuit (PC) boards with various circuits mounted on the PC boards, in accordance with the prior art.

FIG. 1 shows a prior art LED lighting arrangement 10, wherein a power supply 12 supplies power to three series-connected LEDs 14*a*, 14*b* and 14*c*. Other numbers of LEDs could be used, depending on the application, from one to more than three. Control circuits 16 are mounted on a printed-circuit (PC) board 18, together with the power supply 12. LEDs 14*a*-14*c* are mounted on a separate PC board 20. Power supply 12 and control circuits 16, mounted on PC board 18, are typically sold as an LED driver module. As mentioned above, it is desirable to avoid the need to redesign an LED driver module whenever a different control circuit is needed.

Figure 2:
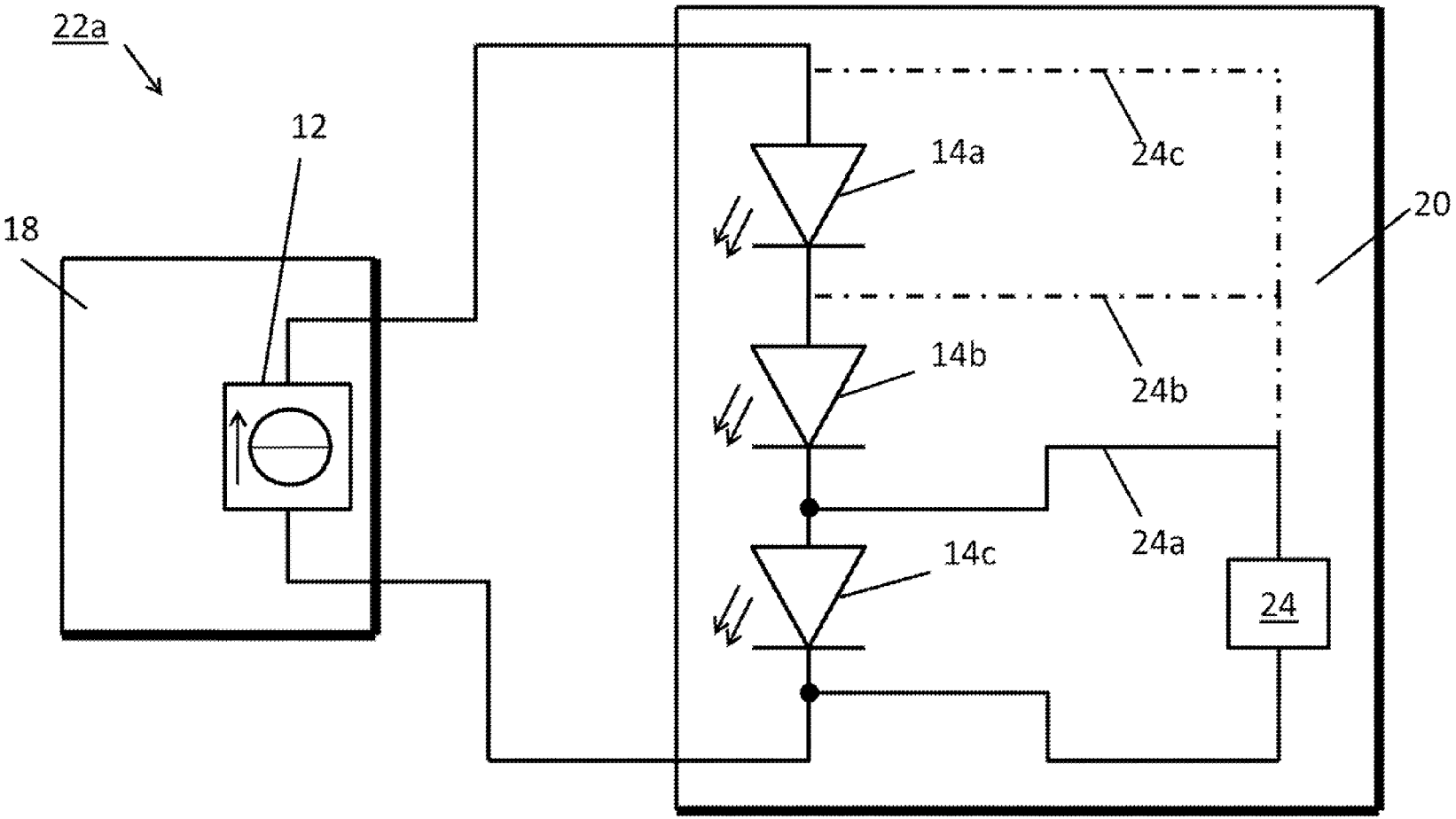
FIG. 2 shows a simplified top plan view, including an electrical schematic, of printed-circuit (PC) boards with various circuits mounted on the PC boards, in accordance with the present invention.
Figure 3A:
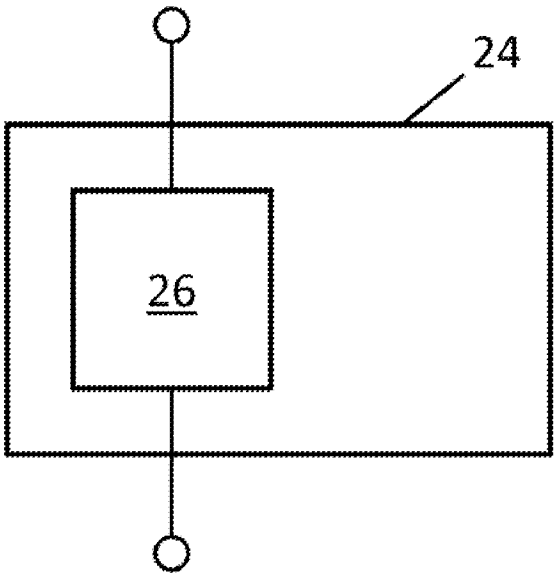
FIGS. 3A and 3B shows respective block diagram views of a circuit from FIG. 2.
Figure 3B:
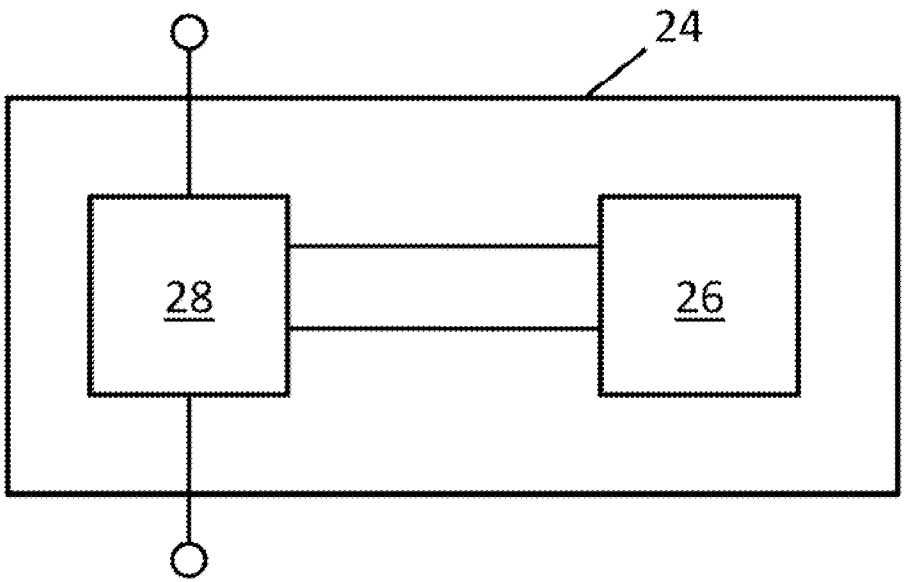

FIG. 2 shows an inventive LED lighting arrangement 22*a*, in which a circuit 24 is powered from one or more LEDs 14*a*-14*c*. That is, the upper electrical lead 24*a* of circuit 24 could be replaced with either electrical lead 24*b* or 24*c*, shown as phantom lines, so that one, two or all three LEDs could power the circuit 24. Circuit 24 can be embodied as shown in FIG. 3A as a control circuit 26, or as shown in FIG. 3B as voltage-conditioning circuit 28, which in turn in connected to a control circuit 26. Voltage-conditioning circuit is discussed below under a related heading.

The LEDs 14*a*-14*c* in LED lighting arrangement 22*a* (FIG. 2) act as coarse voltage regulators because the forward voltage drop across them (e.g., typically about 3.5 volts) remains relatively steady. Such voltage is about 3.5 volts for a single LED 14*c*, about 7 volts for two serially connected LEDs 14*c* and 14*b* and about 10.5 volts for three serially connected LEDs 14*c*, 14*b* and 14*a*. This is true regardless of the current supplied by power supply 12, which typically ranges from 10 mAmps to 10 Amps and depends on the type of LEDs used. Owing to the foregoing inherent trait of LEDs, the voltage at their terminals can be used to power control integrated circuits (IC's) or other control circuits, such as control circuit 26 of FIG. 3A or 3B, which cannot otherwise be powered from constant-current supplies.

Most of the foregoing control IC's draw very little power in relation to the LEDs 14*a*-14*c*, so any drop in light output due to their additional current usage would be minimal. If the amount of current required by a current-intensive control circuit 26 (FIGS. 3A-3B) would result in an unacceptable drop in light output, then the power supply (or driver) 12 for the LEDs is designed to supply sufficient current so as to power the LEDs as well as the current-intensive control circuit. This assures that the desired light output is achieved.

Because LEDs act as coarse voltage regulators, a unique opportunity arises if control circuits, such as control circuit 26 (FIGS. 3A-3B), are mounted to the same PC board 20 to which the LEDs are interconnected and then connected electrically so the voltage drop across the LEDs directly or indirectly powers the control circuits. Because the control circuits are physically remote from the LED power supply 12, more standard LED driver modules can be used for power supply 12, which do not need to include added functionality of other control circuits, since such control circuits can be added to the lighting arrangement and powered by the voltage drop across the LEDs. This reduces LED driver module complexity and cost and improves reliability.

Separating the control circuits from the LED driver module allows for greater flexibility in circuit design in that the LED driver module does not need to be redesigned for each control scheme desired. Also, control circuits can be added at a later time if, for instance, PC board 20 (FIG. 2) to which the LEDs are interconnected contains means (not shown) for mounting additional control circuits whenever desired. For example, a standard LED lighting arrangement can be made that provides a constant light output but has mounting means for additional control circuits. If, at a later time, the end-user decides to add dimming capabilities, or a motion sensor, or wireless controls, for instance, the user can simply plug the appropriate module(s) or component(s) into the PC board to which the LEDs are interconnected and the fixture will respond as desired.

Figure 4:
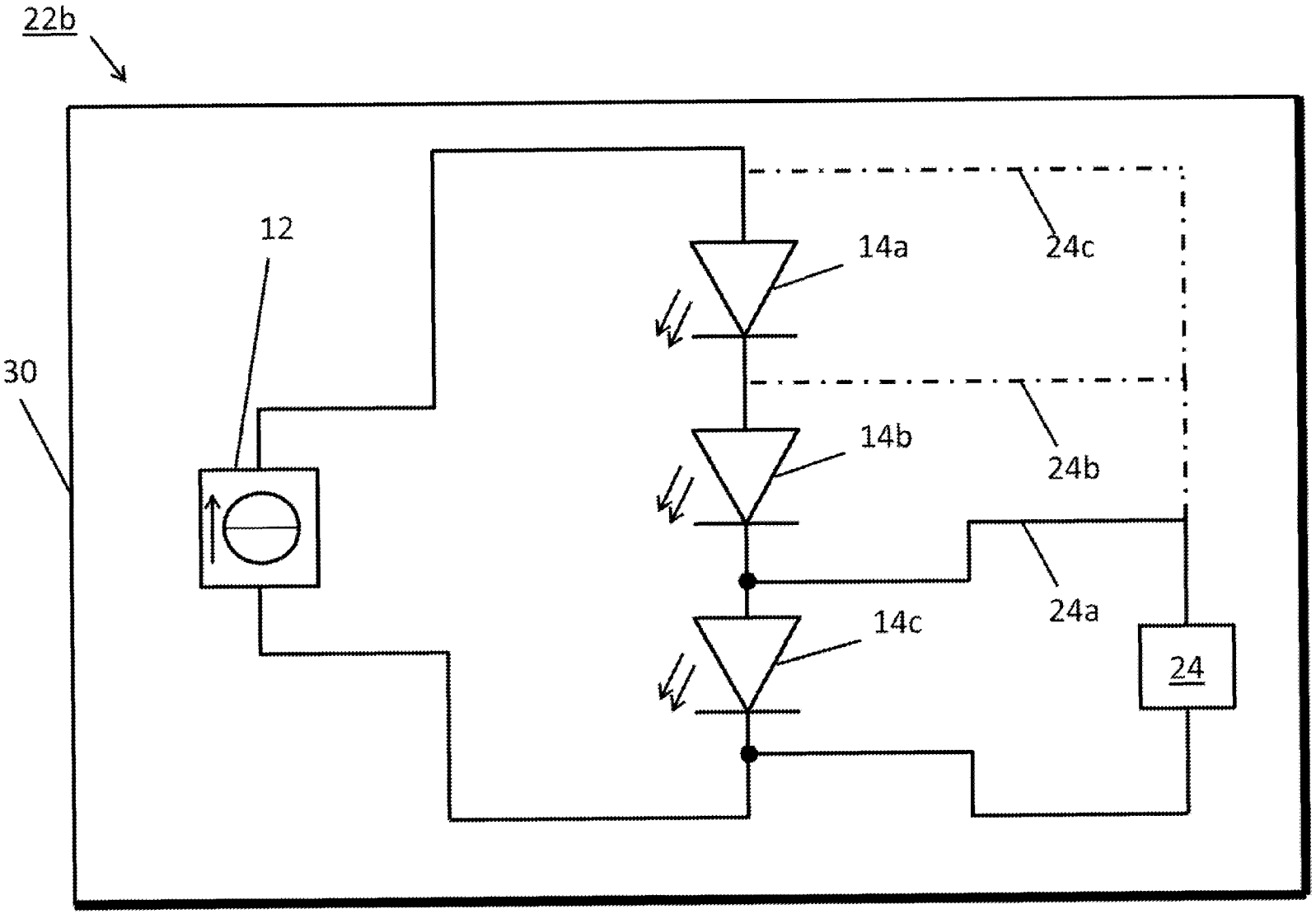
FIGS. 4 and 5 are views similar to FIG. 2, but with differing numbers of PC boards.
Figure 5:
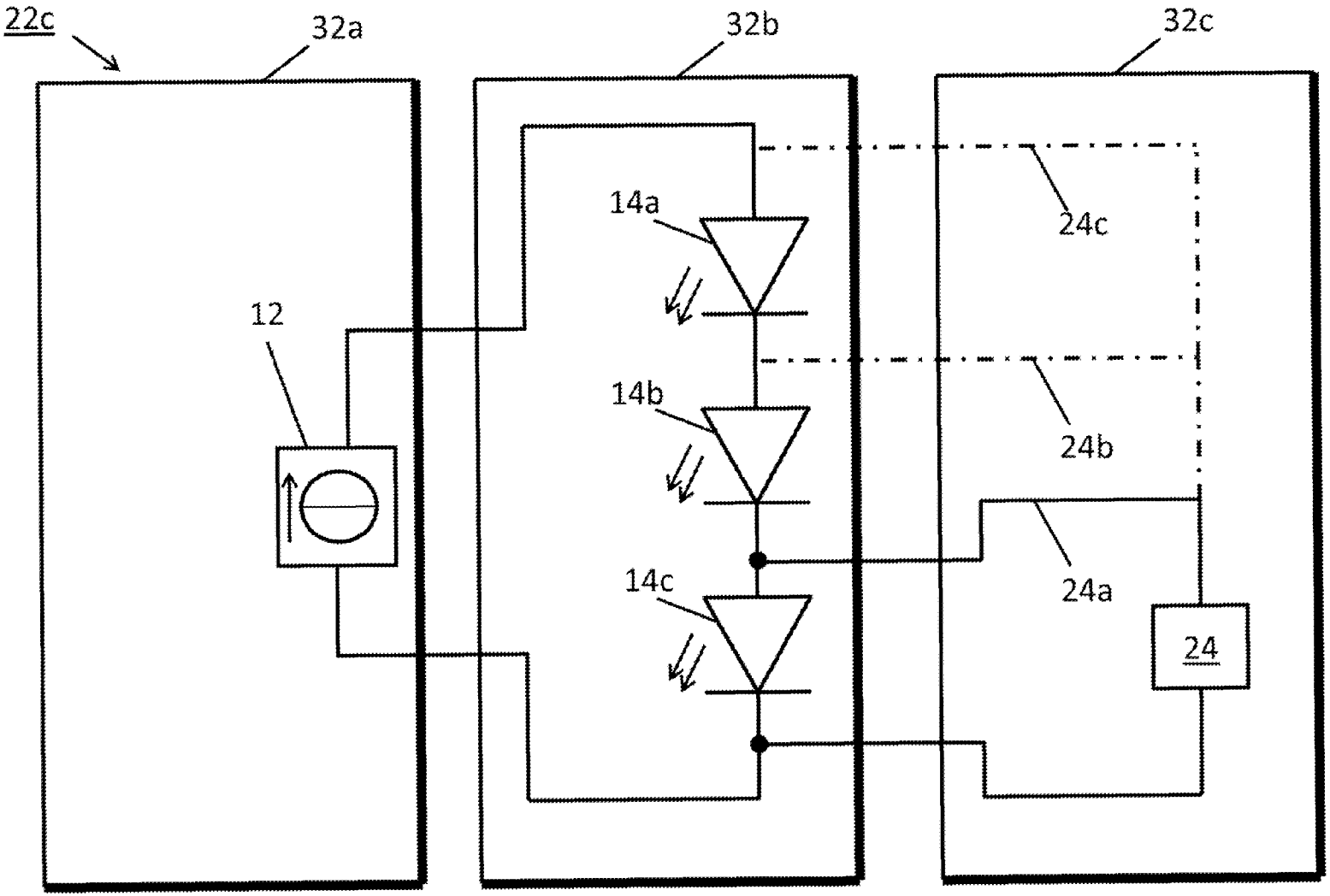

It is not required that all of the control circuits be located on the PC board 20 on which the LEDs 14*a*-14*c* are mounted. If desired, some control circuits (not shown in FIG. 2) can be placed in the LED driver module, i.e., on PC board 18, and others can be placed on the PC board 20 and powered by the LEDs 14*a*-14*c*. Alternatively, as shown in the LED lighting arrangement 22*b* of FIG. 4, the LED power supply 12, the LEDs 14*a*-14*c* and the circuit 24 which contains the control circuit 26 (FIGS. 3A-3B) can be mounted on a single PC board 30. Further alternatively, as shown in the LED lighting arrangement 22*c* of FIG. 5, the LED power supply 12, the LEDs 14*a*-14*c* and the circuit 24 which contains the control circuit 26 (FIGS. 3A-3B) can be mounted on respective PC boards 32*a*, 32*b* and 32*c*.

Figure 6A:
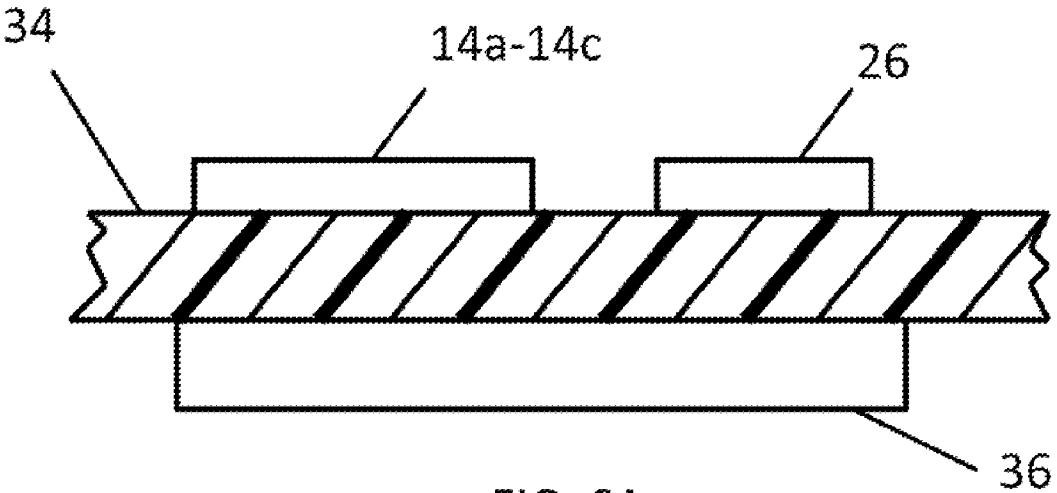
FIGS. 6A and 6B show simplified, cross-sectional views of an LED and a control circuit mounted on a PC board and sharing the same heat sink.
Figure 6B:
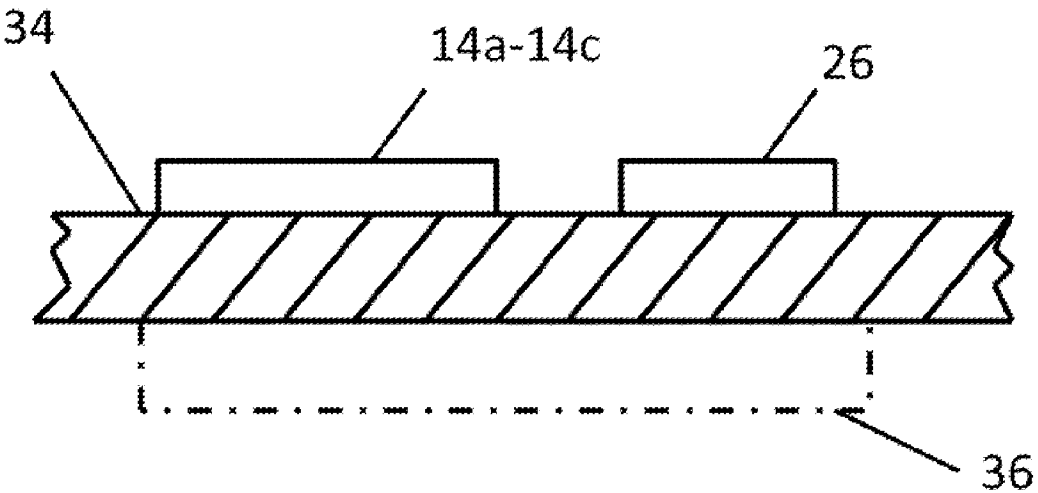

An additional benefit of LED lighting arrangements 22*a* (FIG. 2) and 22*b* (FIG. 4) is that, by mounting circuit 24, which contains the control circuit 26 (FIGS. 3A-3B) on the same PC board to which the LEDs are interconnected, the control circuit(s) can be kept cool using the same heat sink arrangement used by the LEDs. FIG. 6A shows such an arrangement, in which LEDs 14*a*-14*c* and a control circuit 26 are mounted on a PC board 34, to which is attached a heat sink 36. The control circuit 26 advantageously also uses the same heat sink 36. Similarly, FIG. 6B shows LEDs 14*a*-14*c* and a control circuit 26 mounted on a PC board 38 of metallic construction, to which optionally is attached a heat sink 36.

Examples of Control Circuits

Examples of LED lighting control systems, where the control circuits could be mounted on the PC board to which the LEDs are interconnected and not in the LED driver module, include:

- thermal sensors
- RF communications
- IR transceivers
- LED protection circuits
- time clocks
- dimmer controls
- failed LED bypassing or switching on of a spare LED
- electric power utility-scale demand-response circuits to reduce power usage when demand for same is high
- occupancy sensors
- radio frequency identification (RFID) tag readers

Voltage-Conditioning Circuit

Some control circuits 26 (FIGS. 3A-3B) require a tighter voltage range from a power source than an LED(s) can provide, and some control circuits require lesser voltage than an LED(s) can provide. Accordingly, a voltage-conditioning circuit is used.

The voltage-conditioning circuit 28 of FIG. 3B which regulates voltage in a tighter range than an LED(s) provides may be used in the following circumstance. The coarse voltage regulation provided by an LED will typically be of the order of +/−20%. For a 3.5V LED forward drop, this may range between 2.9 and 4.2 volts. For many control circuits this regulation is adequate. Some circuits, however, require a much tighter range of voltages such as from 2.9 to 3.1 Volts. In these cases, a simple 3-terminal voltage regulator may take the input from the LED and provide the additional tighter regulation, referred to herein as "secondary" regulation, required by the control circuits. Such 3-terminal voltage regulators, such as the LM7805, are commonly available from multiple sources, such as from Fairchild Semiconductor of South Portland, Me.

Incidentally, it is impractical to operate the foregoing "secondary" regulators directly from the current source which operates the LEDs for several reasons. First, the voltage of the LED power source is usually too high and would unnecessarily complicate the design of the secondary regulator, or second, the voltage of the LED power source would cause the secondary regulator to be much less efficient than when operated from the coarse regulation provided by an LED.

An alternative voltage-conditioning circuit 28 (FIG. 3B), which provides voltage regulation, uses a resistor and a Zener diode, whose reverse-voltage characteristic provides voltage regulation. Variations of such a circuit will be apparent to a person of ordinary skill in the art based on the present specification.

In cases where the voltage provided by an LED(s) is too high for a control circuit, but where the coarse voltage regulation of the LED(s) is adequate, a simpler voltage-conditioning circuit 28 (FIG. 3B), such as a voltage-divider circuit can be used to lower the voltage from the LED(s).

Additional Benefit for an LED Driver

From the above description, it will be apparent that benefits extend to the LED driver module in that it can be off-the-shelf and/or generic version and therefore less expensive. Also, because some or all the control circuits are removed from the driver, the driver can be kept cooler than if the controls were incorporated into the driver, therefore making the driver more reliable and extending its the life.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. An LED lighting arrangement, comprising:

a) at least one LED, for producing light;

b) a power supply for the at least one LED; and c) at least one control circuit; the at least one control circuit coupled to the at least one LED in a way that directly or indirectly uses, to power the at least one control circuit, one or more forward voltage drops across the at least one LED.

2. The arrangement of claim 1, wherein the power supply provides a constant average current to the at least one LED.

3. The arrangement of claim 1, wherein the at least one LED, the power supply, and the at least one control circuit reside on a single PC board.

4. The arrangement of claim 1, wherein the at least one LED and the at least one control circuit reside on a first PC board and the power supply resides on a second PC board.

5. The arrangement of claim 1, wherein the at least one LED resides on a first PC board, the power supply resides on a second PC board, and the at least one control circuit resides on a third PC board.

6. The LED lighting arrangement of claim 1, further comprising a voltage-conditioning circuit interposed between the at least one LED and the at least one control circuit; the voltage-conditioning circuit providing a higher degree of voltage regulation than provided by the at least one LED.

7. The LED lighting arrangement of claim 1, further comprising a voltage-conditioning circuit interposed between the at least one LED and the at least one control circuit; the voltage-conditioning circuit providing to the at least one control circuit a voltage reduced from the voltage provided by the at least one LED.

8. The arrangement of claim 1, wherein:

a) the at least one LED is thermally connected to a heat sink; and b) at least one of the at least one control circuit is also thermally connected to the same heat sink.

9. The arrangement of claim 1, wherein the control circuit contains one or more of the group of a thermal sensor, RF communication circuitry, an IR transceiver, a circuit for protecting the at least one LED, a time clock, a dimmer control for the at least one LED, a circuit for switching out a failed LED and switching in a spare LED, and an electric power utility demand-response circuit.

* * * * *